US007766708B2

(12) United States Patent
Akuzawa

(10) Patent No.: US 7,766,708 B2
(45) Date of Patent: Aug. 3, 2010

(54) CONTROL DEVICE OF BOAT PROPULSION SYSTEM AND BOAT

(75) Inventor: Shu Akuzawa, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 181 days.

(21) Appl. No.: 12/108,529

(22) Filed: Apr. 24, 2008

(65) Prior Publication Data

US 2008/0268726 A1 Oct. 30, 2008

(30) Foreign Application Priority Data

Apr. 25, 2007 (JP) ..... 2007-115638

(51) Int. Cl.
*B63H 21/22* (2006.01)

(52) U.S. Cl. ..... 440/1; 440/86

(58) Field of Classification Search ..... 440/1, 440/86

See application file for complete search history.

(56) References Cited

U.S. PATENT DOCUMENTS 6,578,550 B1 * 6/2003 Rupp et al. ..... 123/406.13
6,732,713 B1 * 5/2004 Kanazawa et al. ..... 123/476
6,810,724 B2 11/2004 Kimata et al.

FOREIGN PATENT DOCUMENTS

EP 1659285 * 5/2006
JP 09-79125 A 3/1997

* cited by examiner

*Primary Examiner*—Stephen Avila
(74) *Attorney, Agent, or Firm*—Keating & Bennett, LLP

(57) ABSTRACT

An engine in an outboard motor includes a first rotation angle sensing device arranged to sense a rotation angle of a crankshaft and second rotation angle sensing device arranged to sense a rotation angle of an exhaust camshaft. A reverse rotation determination section is arranged to determine an occurrence of a reverse rotation of the crankshaft based on of a rotation angle sensed by the first rotation angle sensing device and a rotation angle sensed by the second rotation angle sensing device. A gear mechanism operation section forceaby shifts a shift gear mechanism into a neutral state when a reverse rotation of the crankshaft is sensed by the reverse rotation determination section. Water is surely prevented from entering the internal combustion engine and can minimize an increase in the manufacturing cost and simplify the maintenance work of the internal combustion engine.

8 Claims, 9 Drawing Sheets

CONTROL DEVICE OF BOAT PROPULSION SYSTEM AND BOAT

BACKGROUND OF THE INVENTION

1. Field of the Invention

The present invention relates to a boat propulsion system, a control device for the boat propulsion system to which a steering wheel device, a remote control device, and the like for operating the boat propulsion system are electrically connected, and a boat including the control device for the boat propulsion system.

2. Description of the Related Art

When a crankshaft rotates in a reverse direction, the directions of intake air and exhaust gas are reversed in a boat propulsion system provided in the boat for providing a propulsive force to a hull by rotating a propeller or the like. Consequently, water flowing in a reverse direction from an exhaust pipe extending into the water enters a cylinder of an internal combustion engine during running. Therefore, a control device for a running condition for the boat which senses a reverse rotation of the crankshaft is necessary in order to prevent water from entering the engine.

As a conventional control device for a running condition for a boat of this type, there is a control device described in JP-A-2003-120397 and JP-A-Hei 9-79125. Specifically, JP-A-2003-120397 describes a control device for a boat propulsion system (a reverse rotation prevention device), including an internal combustion engine provided with a crankshaft which converts movement in a reciprocating direction of a piston into movement in a rotational direction, in which the boat propulsion system providing a propulsive force to a hull is controlled by the drive of the internal combustion engine. The boat propulsion system further includes a control device cylinder discrimination device for discriminating a cylinder of the internal combustion engine, a crank angle signal generation device for generating a prescribed number of crank angle signals for each prescribed crank angle, a counter for counting the crank angle signals generated by the crank angle signal generation device, a count value multiple determination device for determining whether or not a count value of the counter is a multiple of the prescribed number when a cylinder is discriminated by the cylinder discrimination device, and an engine stop device for stopping the internal combustion engine or, specifically, for stopping ignition and fuel injection by determining that the internal combustion engine rotates in a reverse direction when it is determined that the count value is not a multiple of the prescribed number by the count value multiple determination device.

On the other hand, JP-A-Hei 9-79125 describes a control device for a boat propulsion system including a crankshaft provided with a crank which converts movement in a reciprocating direction of a piston into movement in a rotational direction, an injector in a section more upstream than the combustion chamber for injecting fuel with fresh air supplied to a combustion chamber via an intake air passage, a crankcase, a scavenge air passage, and a spark plug in the combustion chamber in which ignition is made at an ignition timing corresponding to an operating state on the basis of a pulse signal. The boat propulsion system further includes an internal combustion engine (two-cycle, fuel-injection type internal combustion engine), wherein the boat propulsion system providing the propulsive force to the hull is controlled by the drive from the internal combustion engine, and a reverse rotation sensing device of the engine is provided and ignition is stopped but fuel injection is continued when a reverse rotation is sensed.

In these documents, it is attempted to prevent water from entering the engine by stopping combustion in the engine when a reverse rotation of a crankshaft is sensed.

However, according to JP-A-2003-120397 and JP-A-Hei 9-79125, for example, when a gear of the boat is shifted from forward drive to reverse drive (or shifted from reverse drive to forward drive), a reaction force from a propeller is suddenly increased. Accordingly, the reaction force may become greater than the rotating torque of a crankshaft thereby rotating the crankshaft in a reverse direction. In a case like this, even after combustion in an engine is stopped, the propeller keeps rotating in a direction of reverse drive (or in a direction of forward drive) by an inertia force. Consequently, the inertia force is transmitted to the engine. Therefore, in the boat propulsion systems described in JP-A-2003-120397 and JP-A-Hei 9-79125, there is a problem in which water may enter the engine by drive of the engine resulting from the inertia force.

In addition, in JP-A-2003-120397 and JP-A-Hei 9-79125, since a complex mechanism and many sensors are necessary for sensing a reverse rotation of the crankshaft, there is a problem in which the manufacturing cost of the internal combustion engine is increased and necessary maintenance work becomes laborious. Moreover, when a special operation is performed in order to prevent water from entering the engine as described above, a special mechanism is necessary for performing such an operation. As a result, there is a problem in which the manufacturing cost of the internal combustion engine is increased and necessary maintenance work becomes laborious.

SUMMARY OF THE INVENTION

In order to overcome the problems described above, preferred embodiments of the present invention provide a control device for a boat propulsion system and a boat which can surely prevent water from entering an internal combustion engine regardless of a state of a gear, and can minimize an increase in the manufacturing cost and simplify the maintenance work of the internal combustion engine.

A first preferred embodiment of the present invention includes a control device for a boat propulsion system having an internal combustion engine provided with a crankshaft which converts movement in a reciprocating direction of a piston into movement in a rotational direction and arranged to control a boat propulsion system providing a propulsive force to a hull by drive from the internal combustion engine, wherein the control device includes a reverse rotation sensing device arranged to sense a reverse rotation of the crankshaft during driving of the internal combustion engine and a gear mechanism operation device arranged to forcibly shift a gear mechanism provided in the boat propulsion system into the neutral state when a reverse rotation of the crankshaft is sensed by the reverse rotation sensing device.

According to a second preferred embodiment of the present invention, the reverse rotation sensing device preferably includes a first rotation angle sensing device arranged to sense a rotation angle of the crankshaft, a second rotation angle sensing device provided in the internal combustion engine and arranged to sense a rotation angle of a camshaft engaged and driven with the crankshaft, and a reverse rotation determination device arranged to determine an occurrence of a reverse rotation of the crankshaft based on a rotation angle sensed by the first rotation angle sensing device and a rotation angle sensed by the second rotation angle sensing device.

According to a third preferred embodiment of the present invention, the first rotation angle sensing device preferably includes a first mark section provided at a specific rotation angle position of the crankshaft and a first passage sensing device provided at a specific position around the crankshaft for sensing whether or not the first mark section passes the specific position, the second rotation angle sensing device preferably includes a second mark section provided at a specific rotation angle position of the camshaft and a second passage sensing device provided at a specific position around the camshaft for sensing whether or not the mark section passes the specific position, and the reverse rotation determination device determines that the crankshaft reversely rotates if the first mark section and the second mark section are sensed at a timing different from that of a time when the camshaft normally rotates.

According to a fourth preferred embodiment of the present invention, at least one of the first mark section and the second mark section is preferably a protruding portion provided at a specific rotation angle position on the crankshaft or the camshaft, or an omitted portion resulting from omitting a portion at a specific rotation angle position from a plurality of the protruding portions provided at regular intervals, and at least one of the first passage sensing device and the second passage sensing device is a magnetic sensor provided in a vicinity of a projected position of the protruding portion.

In addition to any one of the preferred embodiments above, a fifth preferred embodiment of the present invention preferably further includes a drive stop device arranged to stop an operation of an injector for providing a combustion chamber of the internal combustion engine with fuel and an operation of an ignition coil for igniting fuel in the combustion chamber injected by the injector when a reverse rotation of the crankshaft is sensed by the reverse rotation sensing device.

In addition to anyone of the preferred embodiments described above, a sixth preferred embodiment of the present invention preferably further includes a processing avoidance device arranged to avoid processing by the gear mechanism operation device when a rotational speed of the internal combustion engine is equal to or more than a prescribed speed.

A seventh preferred embodiment of the present invention includes a boat including the control device for a boat propulsion system according to any one of the preferred embodiments described above.

The first preferred embodiment of the present invention is provided with the reverse rotation sensing device arranged to sense a reverse rotation of the crankshaft during driving of the internal combustion engine and the gear mechanism operation device arranged to forcibly shift a gear mechanism provided in the boat propulsion system into the neutral state when a reverse rotation of the crankshaft is sensed by the reverse rotation sensing device. As a result, when a reverse rotation of the crankshaft occurs during an operation of the internal combustion engine, the reverse rotation is sensed, and the gear mechanism can be shifted into the neutral state in which the reverse rotation of the crankshaft does not occur. In addition, since the gear mechanism operation device shifts the gear mechanism in the neutral state which is one of the states provided by the gear mechanism during a normal operation of the internal combustion engine, it is not necessary to make the gear mechanism and the like perform a special operation. Accordingly, a special complex construction is not necessary. As a result, it is possible to surely prevent water from entering the internal combustion engine regardless of a state of the gear and to minimize an increase in the manufacturing cost and simplify the maintenance work of the internal combustion engine.

According to the second preferred embodiment of the present invention, the first rotation angle sensing device arranged to sense a rotation angle of the crankshaft and the second rotation angle sensing device provided in the internal combustion engine arranged to sense a rotation angle of the camshaft engaged and driven with the crankshaft are preferably sensors in the reverse rotation sensing device. As a result, the construction can be made by a small number of sensors. In addition, the reverse rotation determination device arranged to determine an occurrence of a reverse rotation of the crankshaft based on a rotation angle sensed by the first rotation angle sensing device and a rotation angle sensed by the second rotation angle sensing device is provided. Therefore, a reverse rotation of the crankshaft can be surely sensed based on a relative relationship between a rotation angle of the crankshaft and a rotation angle of the camshaft. As a result, it is possible to more surely prevent water from entering the internal combustion engine regardless of a state of the gear and to minimize an increase in the manufacturing cost and further simplify the maintenance work of the internal combustion engine.

According to the third preferred embodiment of the present invention, the first rotation angle sensing device has the first mark section provided at a specific rotation angle position of the crankshaft and the first passage sensing device provided at a specific position around the crankshaft arranged to sense whether or not the first mark section passes the specific position, the second rotation angle sensing device has the second mark section provided at a specific rotation angle position of the camshaft and the second passage sensing device provided at a specific position around the camshaft for sensing whether or not the mark section passes the specific position, and the reverse rotation determination device determines that the crankshaft performs a reverse rotation if the first mark section and the second mark section are sensed at a timing different from that of a time when the camshaft performs a normal rotation. As a result, an occurrence of a reverse rotation of the crankshaft can be sensed based on a positional relationship of the specific rotation angle positions provided on the crankshaft and the camshaft and a passing state of the specific rotation angle positions. Further, since the specific rotation angle positions of the crankshaft and the camshaft can be sensed by using the mark sections provided at the specific rotation angle positions, an arrangement for sensing the specific rotation angle positions can be simple. As a result, it is possible to more surely prevent water from entering the internal combustion engine regardless of a state of the gear and to minimize an increase in the manufacturing cost and further simplify the maintenance work of the internal combustion engine.

According to the fourth preferred embodiment of the present invention, at least one of the first mark section and the second mark section is preferably a protruding portion provided at a specific rotation angle position on the crankshaft or the camshaft, or an omitted portion resulting from omitting a portion at a specific rotation angle position from a plurality of the protruding portions provided at regular intervals. As a result, the mark sections for indicating the specific rotation angle position can be formed in a simple construction. Further, at least one of the first passage sensing device and the second passage sensing device is preferably a magnetic sensor provided in a vicinity of a projected position of the protruding portion. As a result, the passage sensing device can be formed in a simple construction. Consequently, it is possible to more surely prevent water from entering the internal combustion engine regardless of a state of the gear and to minimize an increase in the manufacturing cost and further simplify the maintenance work of the internal combustion engine.

According to the fifth preferred embodiment of the present invention, a drive stop device is arranged to stop an operation of an injector provided in a combustion chamber of the internal combustion engine with fuel and an operation of an ignition coil igniting fuel in the combustion chamber injected by the injector when a reverse rotation of the crankshaft is sensed by the reverse rotation sensing device. As a result, a factor for generating combustion in the combustion chamber at a time of a reverse rotation of the crank shaft, which is a factor for intensifying the reverse rotation of the crankshaft, is blocked, and it is possible to more surely prevent water from entering the internal combustion engine regardless of a state of the gear.

According to the sixth preferred embodiment of the present invention, the processing avoidance device arranged to avoid processing by the gear mechanism operation device when the rotational speed of the internal combustion engine is equal to or more than a prescribed speed is provided. As a result, it is prevented that a running trouble occurs when the gear mechanism is shifted in the neutral state despite the fact that a reverse rotation of the crankshaft does not occur because the gear mechanism is forcibly shifted in the neutral state due to an incorrect detection in a case other than a low rotational speed of the engine such as during usual running. Consequently, it is possible to surely prevent water from entering the internal combustion engine regardless of a state of the gear and to attempt safe running.

According to the seventh preferred embodiment of the present invention, it is possible to provide a boat equipped with the control device.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will be described hereinafter.

FIG. 1 to FIG. 9B illustrate a first preferred embodiment of the present invention.

Figure 1:
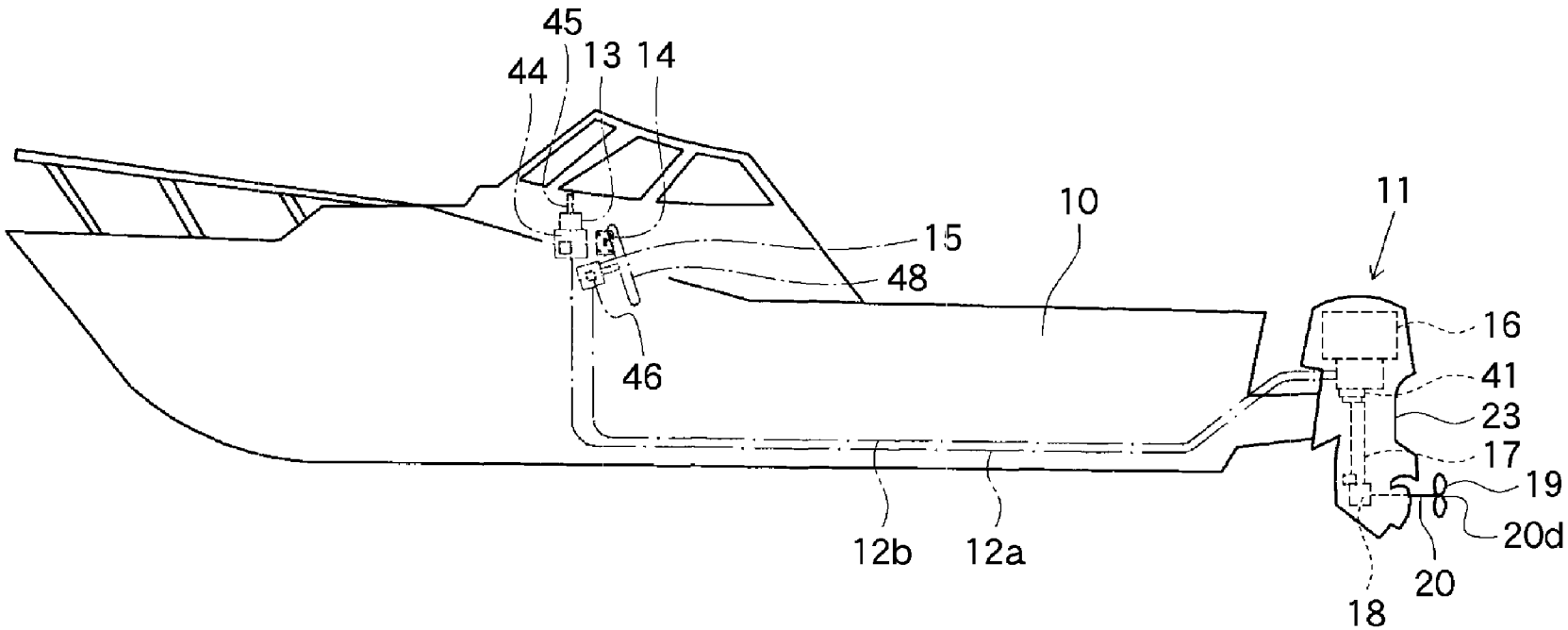
FIG. 1 is a side view of a boat according to a preferred embodiment of the present invention.

As shown in FIG. 1, an outboard motor 11 as an example of a boat propulsion system is attached to a stern of a hull 10 of a boat. The outboard motor 11 is controlled by a remote control operation device 13, a key switch device 14, a steering wheel device 15, and the like disposed around an operator's seat of the hull 10.

As shown in FIG. 1, an internal combustion engine 16 as an example of an engine is disposed in an upper section of the outboard motor 11. Output of the engine 16 rotates a propeller 19 via a drive shaft 17, a shift device 18, and a propeller shaft 20.

Figure 2:
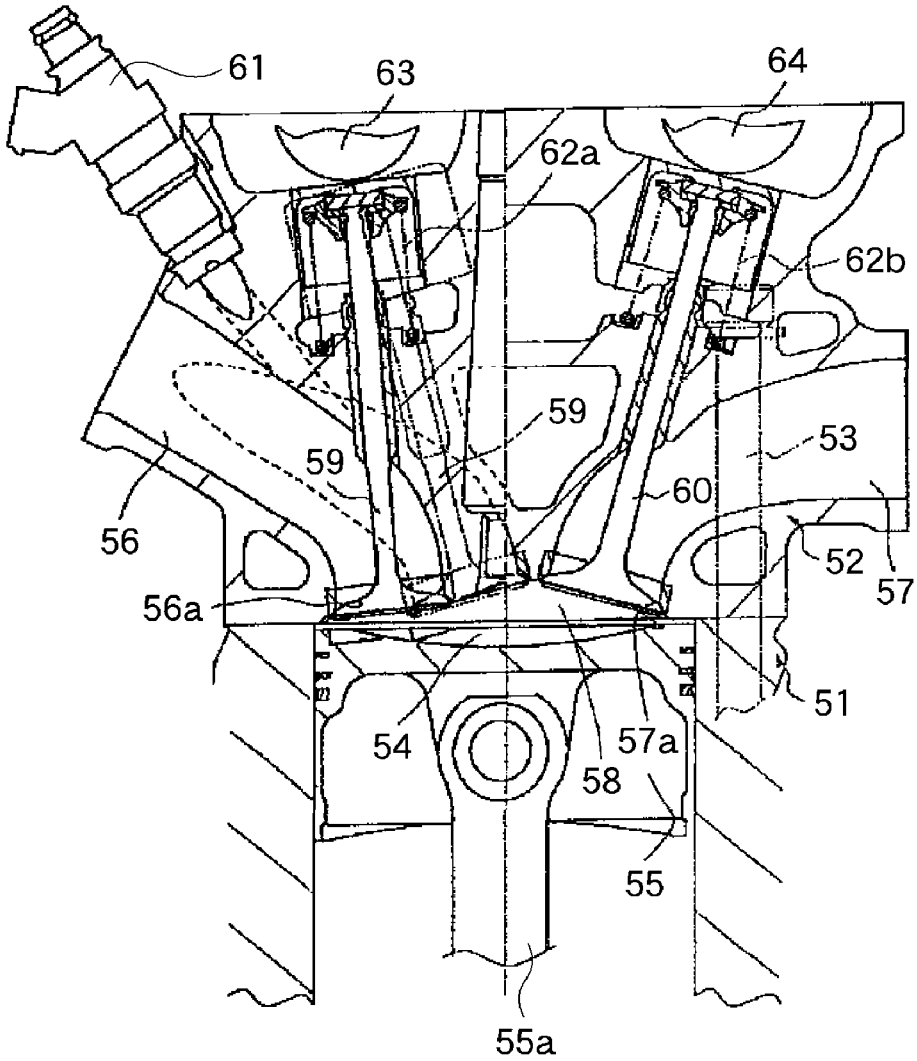
FIG. 2 is a cross-sectional view of an engine provided in an outboard motor.
Figure 3:
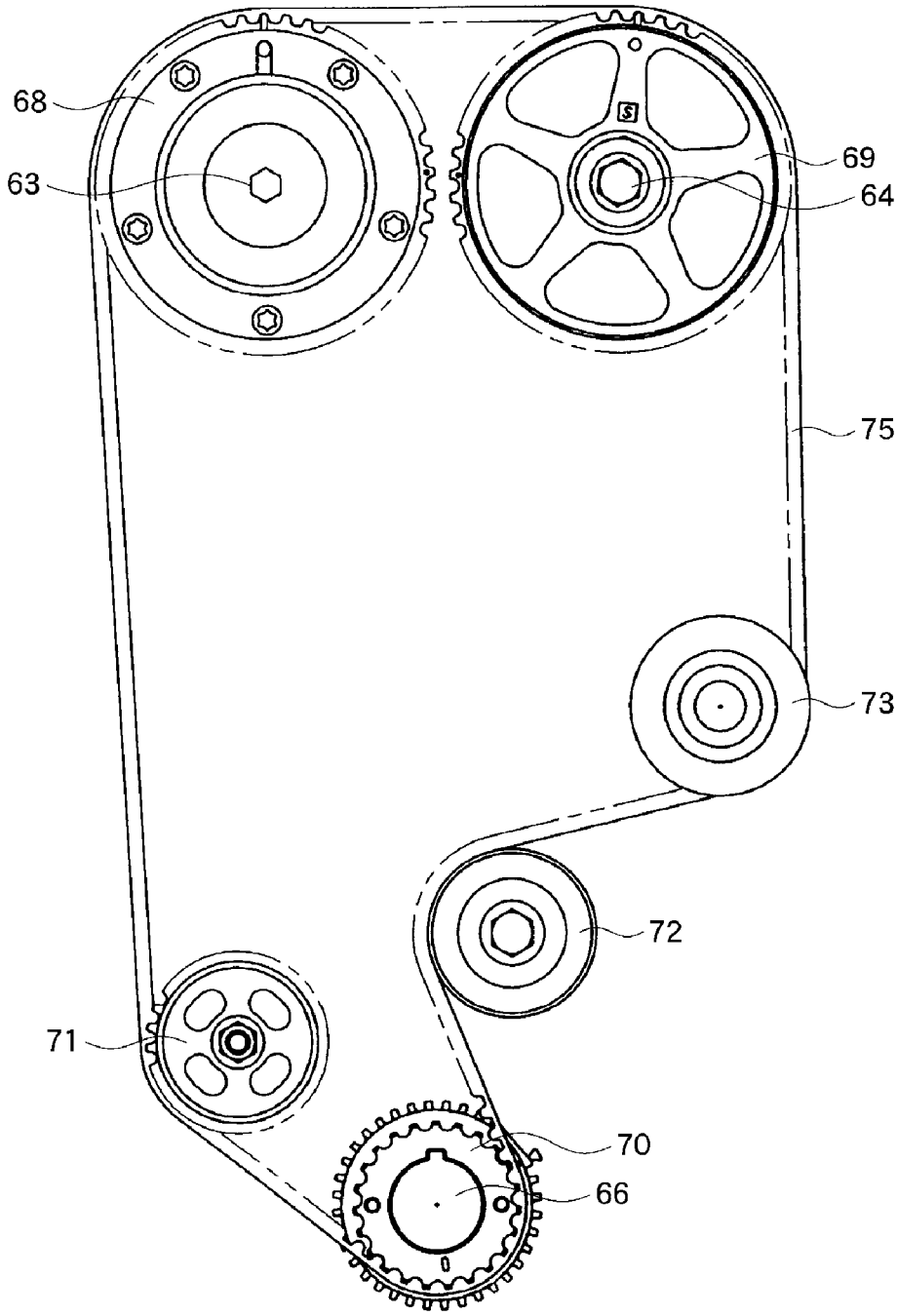
FIG. 3 is a drawing illustrating the relationship of positions of a camshaft, a crankshaft, and the like in the engine provided in the outboard motor.

As shown in FIG. 2, the engine 16 in the present preferred embodiment is a four-cycle engine having a variable valve timing mechanism. However, the number of cylinders and an arrangement thereof may be any number and any arrangement. A construction of one cylinder and one piston will be described hereinafter. Cylinders and pistons provided in the engine 16 all have the same construction as the one cylinder and the one piston.

A cylinder head 52 is attached on an upper side of a cylinder block 51 in the engine 16 by a head bolt 53. A cylinder chamber 54 is provided in the cylinder block 51. A piston 55 is disposed reciprocatively in the vertical direction in the cylinder chamber 54. One end of a connecting rod 55*a* is connected to the piston 55. Another end of the connecting rod 55*a* is connected to a crankshaft 66 provided with a crank (not shown) which converts movement in a reciprocating direction of the piston 55 into movement in a rotational direction. A transmission mechanism such as a gear (not shown) for transmitting power to the drive shaft 17 shown in FIG. 1 is connected to the crankshaft 66.

Further, an intake port 56 and an exhaust port 57 are provided in the cylinder head 52. Openings 56*a* and 57*a* of each of the ports 56 and 57 facing a combustion chamber 58 are opened or closed by an intake valve 59 and an exhaust valve 60. An injector 61 for injecting fuel supplied to the combustion chamber 58 is provided on the intake port 56. An ignition coil 65 (see FIG. 6) is provided for igniting fuel in the combustion chamber 58.

Each of the valves 59 and 60 is biased by coil springs 62*a* and 62*b* in a direction in which the openings 56*a* and 57*a* are closed, and the valves are opened or closed by an intake camshaft 63 and an exhaust camshaft 64.

Intake and exhaust cam pulleys 68 and 69 and a crank pulley 70 are provided at ends of the intake and exhaust camshafts 63 and 64 and the crankshaft 66, respectively. A cam belt 75 is engaged with each of the pulleys 68, 69, and 70 and three intermediate pulleys 71, 72, and 73. Accordingly, drive power from the crankshaft 66 is transmitted to the intake and exhaust camshafts 63 and 64 via the cam belt 75.

A first rotation angle sensing device 80 and a second rotation angle sensing device 90 defining a reverse rotation sensing device arranged to sense a reverse rotation of the crankshaft 66 at a time of driving the engine 16 are provided on the crankshaft 66, on the exhaust camshaft 64, or around other shafts.

Figure 6:
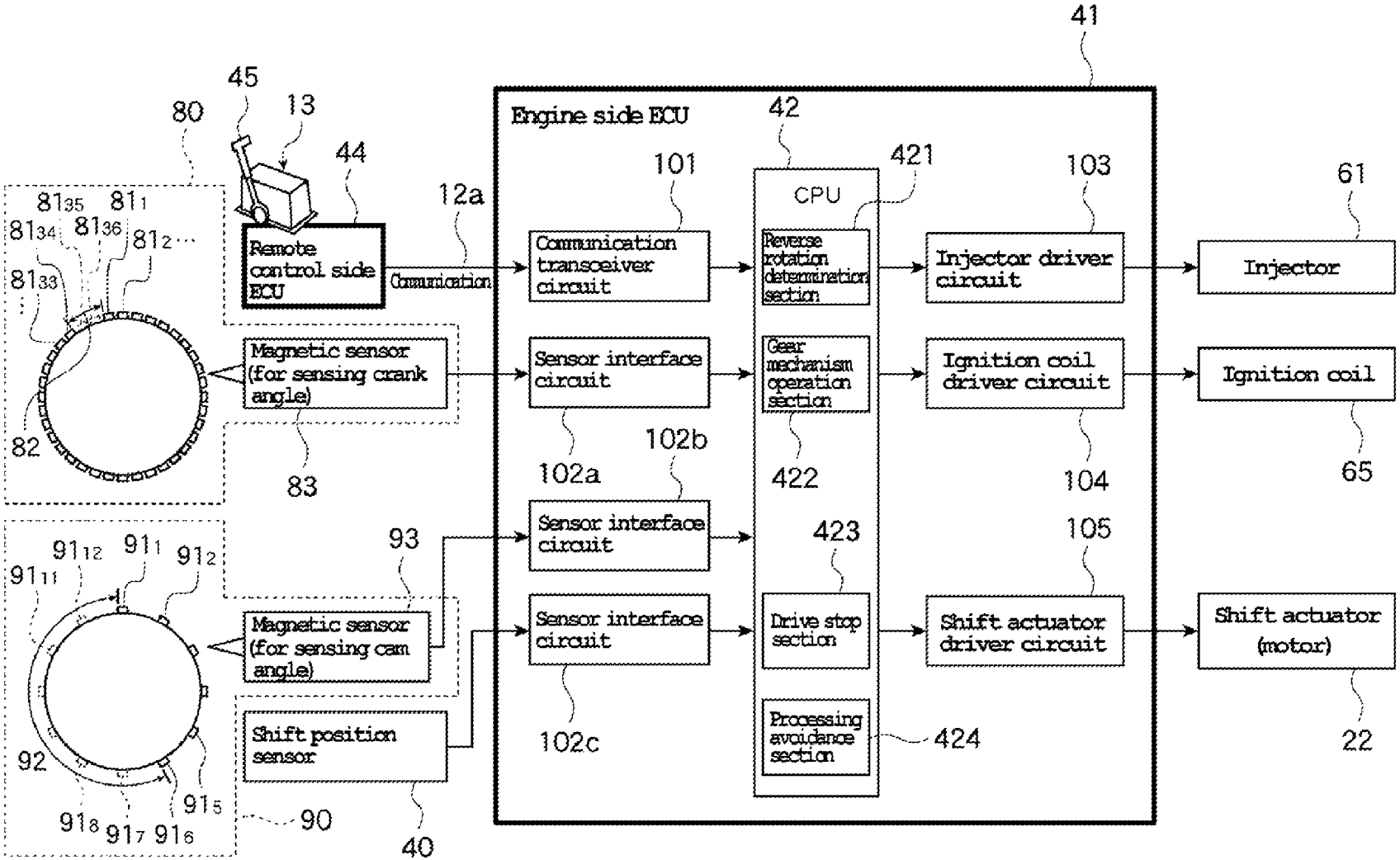
FIG. 6 shows a function block diagram illustrating a portion of a control device for a boat propulsion system according to a preferred embodiment of the present invention.

The first rotation angle sensing device 80 is provided on the crankshaft 66 and in a vicinity thereof. Specifically, as schematically shown in FIG. 6, this first rotation angle sensing device 80 includes protruding portions $\mathbf{81}_1$, $\mathbf{81}_2$, . . . , and $\mathbf{81}_{34}$ as a first mark section provided at specific positions around the crankshaft 66, an omitted portion 82, and a magnetic sensor 83 as a first passage sensing device provided in a vicinity of the protruding portions $\mathbf{81}_1$, $\mathbf{81}_2$, . . . , and $\mathbf{81}_{34}$ and the omitted portion 82. The protruding portions $\mathbf{81}_1$, $\mathbf{81}_2$, . . . , and $\mathbf{81}_{34}$ are provided at equal intervals of 10 degrees from a center portion of the crankshaft 66 to define a specific rotation angle position (in other words, provided at positions 0, 10, 20, 320, and 330 degrees from the center portion). As schematically shown in FIG. 6, the omitted portion 82 is arranged in a position in which protruding portions $\mathbf{81}_{35}$ and $\mathbf{81}_{36}$ would be provided if the protruding portions $\mathbf{81}_1$, $\mathbf{81}_2$, . . . , and $\mathbf{81}_{34}$ extended fully around the crankshaft 66 (in other words, provided at positions of 340 and 350 degrees), but wherein the protruding portions $\mathbf{81}_{35}$ and $\mathbf{81}_{36}$ are actually not provided.

Further, the second rotation angle sensing device 90 is provided on the exhaust camshaft 64 and in a vicinity thereof. Specifically, as schematically shown in FIG. 6, the second rotation angle sensing device 90 includes protruding portions $\mathbf{91}_1$, $\mathbf{91}_2$, . . . , and $\mathbf{91}_6$ as a second mark section provided at specific positions around the exhaust camshaft 64, an omitted portion 92, and a magnetic sensor 93 as a second passage sensing device provided in a vicinity of the protruding portions $\mathbf{91}_1$, $\mathbf{91}_2$, . . . , and $\mathbf{91}_6$ and the omitted portion 92. The protruding portions $\mathbf{91}_1$, $\mathbf{91}_2$, . . . , and $\mathbf{91}_6$ are provided at equal intervals of 30 degrees from a center portion of the exhaust camshaft 64 as a specific rotation angle position (in other words, provided at positions 0, 30, 60, . . . , and 150 degrees from the center portion). As schematically shown in FIG. 6, the omitted portion 92 is arranged in a position in which protruding portions $\mathbf{91}_7$, $\mathbf{91}_8$, . . . , and $\mathbf{91}_{12}$ are would be provided if the protruding portions $\mathbf{91}_1$, $\mathbf{91}_2$, . . . , and $\mathbf{91}_6$ extended fully around the exhaust camshaft 64 (in other words, provided at positions of 180, 210, 240, 270, 300, and 330 degrees), but wherein the protruding portions $\mathbf{91}_7$, $\mathbf{91}_8$, . . . , and $\mathbf{91}_{12}$ are actually not provided.

A rotation angle sensing device similar to the second rotation angle sensing device may be provided on the intake camshaft 63 and in a vicinity thereof.

Figure 4:
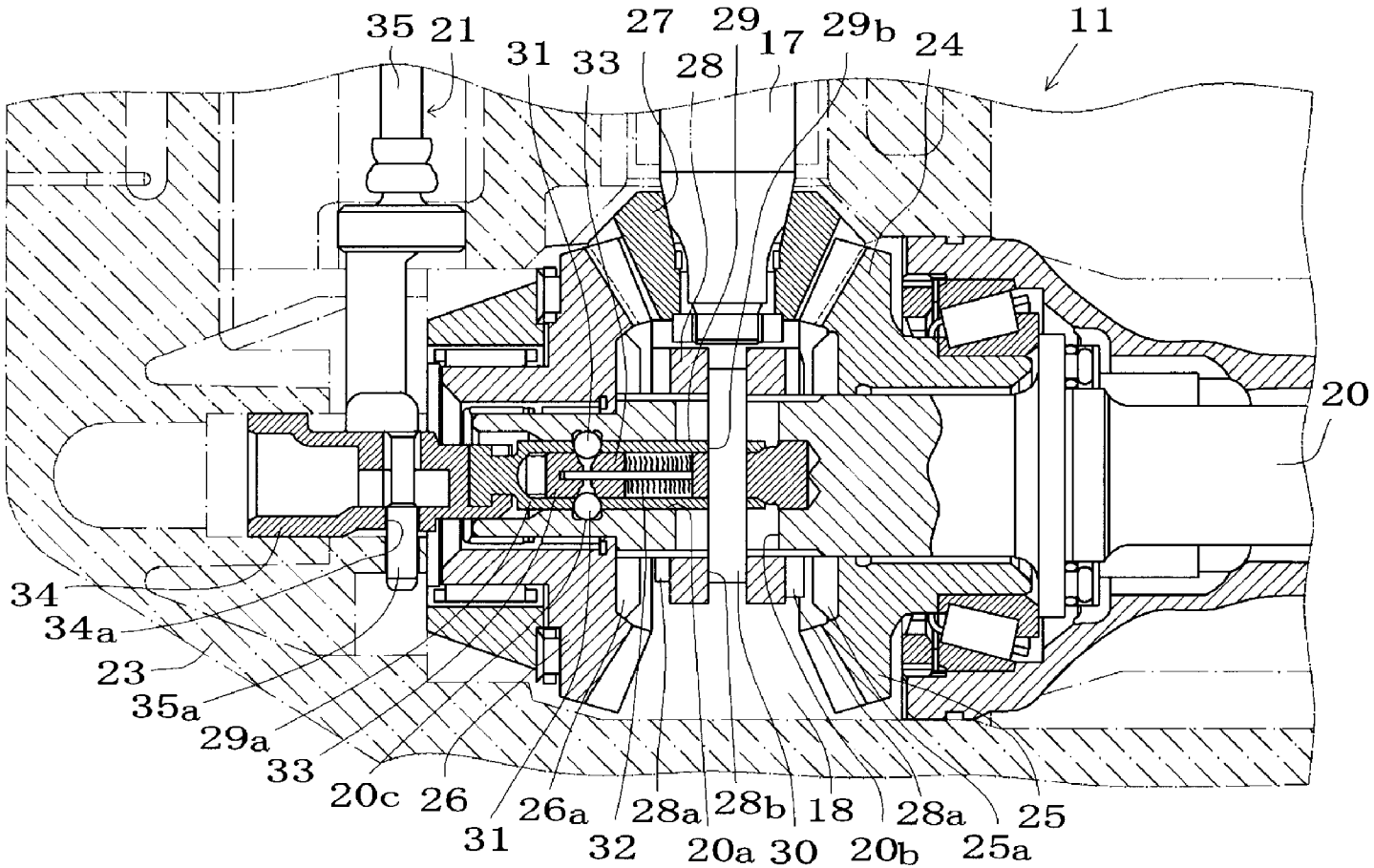
FIG. 4 is a cross-sectional view of a major portion illustrating a shift device of the outboard motor according to a preferred embodiment of the present invention.
Figure 5:
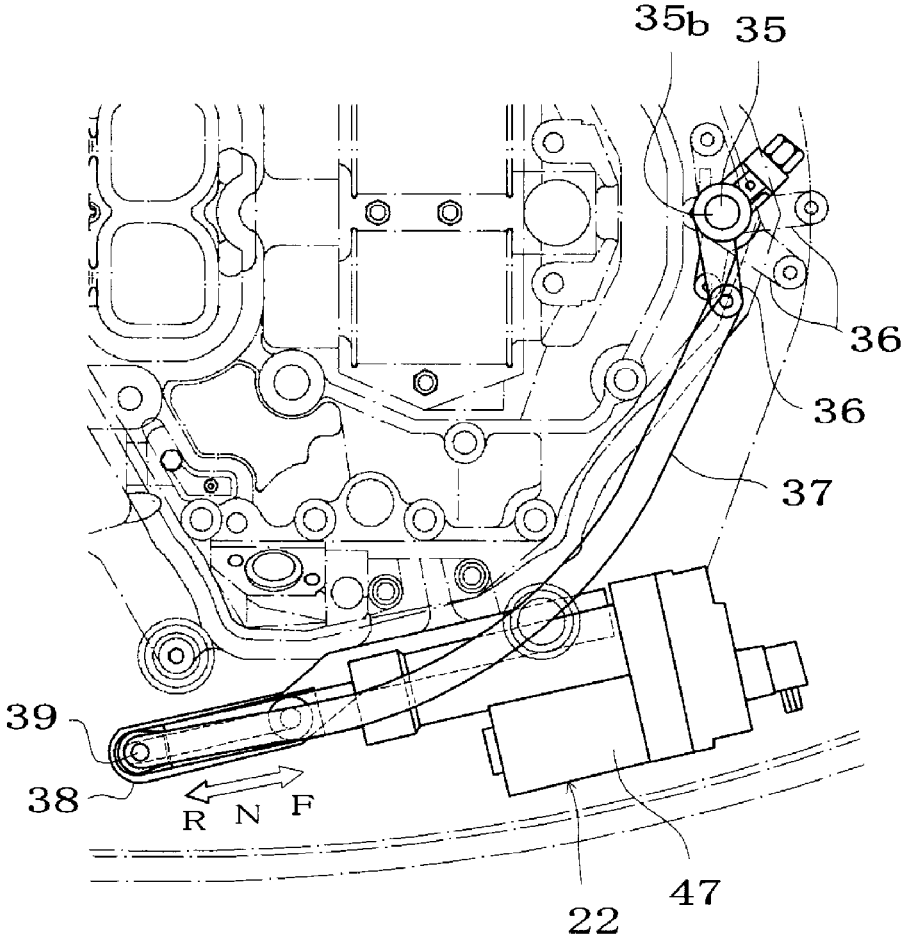
FIG. 5 is a plan view of a major portion illustrating a shift actuator and the like of the outboard motor.

As shown in FIG. 1, the propeller 19 is attached to the propeller shaft 20 which is disposed generally horizontally in a casing 23 in a lower section of the outboard motor 11. As shown in FIG. 4 and FIG. 5, the propeller shaft 20 is connected to the vertically provided drive shaft 17 via a shift gear mechanism 24 as a gear mechanism to achieve a forward-rearward drive shift function. The shift gear mechanism 24 is provided with a forward-drive gear 25 and a rearward-drive gear 26 rotatably attached to the propeller shaft 20. The gears 25 and 26 are meshed with a pinion 27 fixed on the drive shaft 17 to rotate rightward in a top view and rotate in a direction opposite to each other.

In the present preferred embodiment, the forward-drive gear 25 is disposed on a rear side of a forward-drive direction of the boat (in a left direction of FIG. 4), while the rearward-drive gear 26 is disposed on a front side of the forward-drive direction.

The propeller shaft 20 preferably has a cylindrical or substantially cylindrical shape, an inside thereof a path is defined for exhaust gas resulting from combustion in the combustion chamber 58, and an end thereof has an opening forming an exhaust port 20*d* as shown in FIG. 1.

As shown in FIG. 4 and FIG. 5, a dog clutch 28 in a shape of a sleeve is connected by a spline to an outer surface of the propeller shaft 20 between the forward-drive gear 25 and the rearward-drive gear 26. The dog clutch 28 is slidable in the axial direction of the propeller shaft 20. A pawl 28*a* projecting on both sides in the axial direction is provided on the dog clutch 28. In addition, pawls 25*a* and 26*a* facing the pawl 28*a* are provided on the forward-drive gear 25 and the rearward-drive gear 26, respectively. A clutch is formed by meshing the pawls 25*a*, 26*a*, and 28*a*.

Further, an insertion hole 20*a* having an opening at a front end thereof along the axial direction is provided on a side of a front end of the propeller shaft 20, and a shift sleeve 29 is inserted slidably in the axial direction to the insertion hole 20*a*. A longer hole 20*b* in the axial direction is provided on a side of a wall of the insertion hole 20*a* of the propeller shaft 20.

Moreover, through holes 29*b* and 28*b* along the radial direction are formed in the shift sleeve 29 and the dog clutch 28, a pin 30 is inserted in the through hole 28*b* of the dog clutch 28, the longer hole 20*b* of the propeller shaft 20, and the through hole 29*b* of the shift sleeve 29.

The pin 30 is moved in the axial direction within a range of the longer hole 20*b* by the fact that the shift sleeve 29 moves. The dog clutch 28 is moved along the axial direction of the propeller shaft 20 via the pin 30.

In addition, the shift sleeve 29 is provided with a detent ball 31 engaged with or disengaged from a recess 20*c* of the propeller shaft 20 in a manner capable of protruding from and withdrawing into an outer circumference of the shift sleeve 29. The detent ball 31 is biased in a direction of protruding by a spring 32 and a pressing member 33.

Moreover, as shown in FIG. 4, a slidable shifter 34 is connected to a front end 29*a* of the shift sleeve 29. An engaging groove 34*a* is provided along the vertical direction of the shifter 34.

In addition, a driving pin 35*a* provided at a position in the shape of a crank eccentric to a rotational axis is inserted into the engaging groove 34*a* of the shifter 34 at a lower end of a shift shaft 35 of a shift change device 21. As the driving pin 35*a* eccentrically rotates by a rotation of the shift shaft 35, the shifter 34 is slid, and the dog clutch 28 is slid.

As the shift shaft 35 is rotated in one direction, the dog clutch 28 is slid in one direction. On the other hand, as the shift shaft 35 is rotated in the other direction, the dog clutch 28 is slid in the other direction.

As shown in FIG. 5, the shift shaft 35 extends in an upper direction, and a lever 36 is fixed on an upper end 35*b* of the shift shaft 35. One end of a lever shift rod 37 is rotatably connected to an end of the lever 36, and another end of the lever shift rod 37 is rotatably connected to a slider 39 slidably provided on a shift rail 38. As the slider 39 is slid in a prescribed direction by a shift actuator 22, the shift shaft 35 is rotated in a prescribed direction via the lever shift rod 37 and the lever 36.

The shift actuator 22 has a shift motor 47 as a DC motor for a power source, a deceleration mechanism, and the like and actuates the slider 39 in a prescribed direction.

As shown in FIG. 6, a shift position sensor 40 is provided to the shift actuator 22. A shift position (a forward-drive position, the neutral position, and a rearward-drive position) is detected by the shift position sensor 40, and detection information (a signal) is input to an engine side ECU 41 (an engine control unit).

Further, as shown in FIG. 1, the engine side ECU 41 is connected to a remote control side ECU 44 as an electronic control unit provided in the remote control operation device 13 and a steering wheel side ECU 46 as an electronic control unit provided in the steering wheel device 15 by harnesses 12*a* and 12*b* as signal wires. Consequently, operation information on a remote control shift lever 45 and operation information on a steering wheel 48 on a side of the operator's seat is transmitted to the engine side ECU 41 by network communication via the harnesses 12*a* and 12*b*. As a result, the engine side ECU 41 is enabled to perform control of steering of the outboard motor 11 and an operation state of the engine 16 based on the operation information.

As shown in a function block diagram in FIG. 6, the engine side ECU 41 has a CPU (central processing unit) 42, a communication transceiver circuit 101, sensor interface circuits 102*a*, 102*b*, and 102*c*, an injector driver circuit 103, an ignition coil driver circuit 104, and a shift actuator driver circuit 105. The CPU 42 performs arithmetic processing such as various types of programs stored in a ROM (read only memory) not shown and controls the entire processing in the engine side ECU 41. The communication transceiver circuit 101 performs various types of processing necessary for communication with the remote control side ECU 44. The sensor interface circuits 102*a*, 102*b*, and 102*c* perform various types of processing necessary for supplying the CPU 42 with signals transmitted from the magnetic sensors 83 and 93 provided on the crankshaft 66 and the exhaust camshaft 64 and the shift position sensor 40. The injector driver circuit 103, the ignition coil driver circuit 104, and the shift actuator driver circuit 105 perform various types of processing necessary for operating the injector 61 and the ignition coil 65 provided on the crankshaft 66 and the exhaust camshaft 64 and the shift actuator 22 based on a result of processing in the CPU 42.

A functional device for forming the reverse rotation sensing device is created as a result of arithmetic processing of a program stored in a storage device or the like in the CPU 42 of the engine side ECU 41. Specifically, a reverse rotation determination section 421 as a reverse rotation determination device, a gear mechanism operation section 422 as a gear mechanism operation device, a drive stop section 423 as a drive stop device, and a processing avoidance section 424 as a processing avoidance device define the functional device. The reverse rotation determination section 421 determines whether or not a reverse rotation of the crankshaft 66 occurs based on a rotation angle of the crankshaft 66 sensed by the magnetic sensor 83 and a rotation angle of the exhaust camshaft 64 sensed by the magnetic sensor 93, and detects the rotational speed of the engine 16 (more details will be described below). When a reverse rotation of the crankshaft 66 is detected, the gear mechanism operation section 422 forcibly shifts the shift gear mechanism 24 to the neutral state. When a reverse rotation of the crankshaft 66 is detected, the drive stop section 423 stops an operation of the injector 61 and an operation of the ignition coil 65. When the rotational speed of the engine 16 is equal to or more than a prescribed speed, the processing avoidance section 424 avoids processing in the gear mechanism operation section 422.

An operation of the present preferred embodiment will be described hereinafter.

Figure 7:
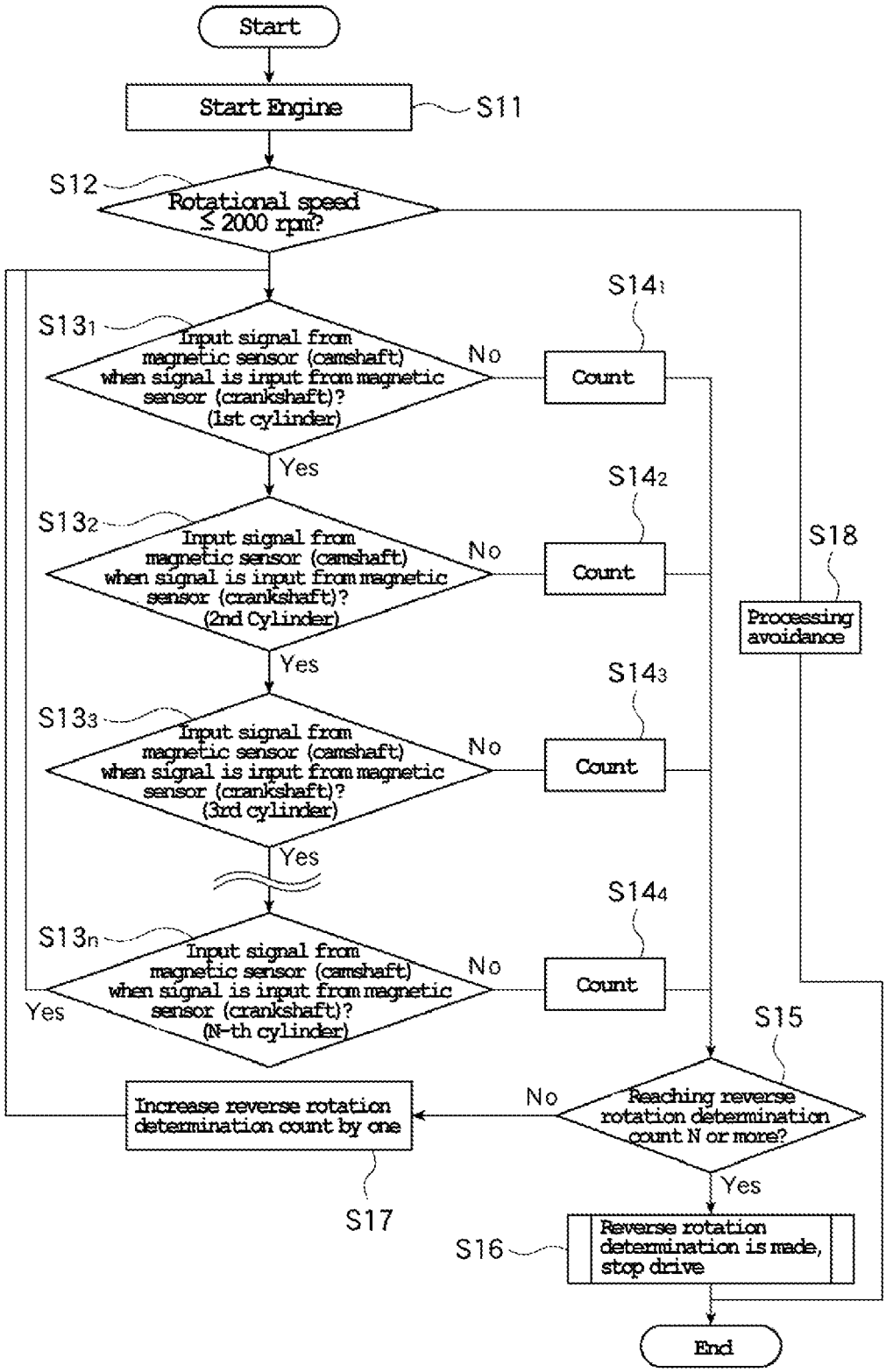
FIG. 7 is a flowchart illustrating a basic control procedure of the control device for the boat propulsion system according to a preferred embodiment of the present invention.

FIG. 7 is a flow chart illustrating a basic procedure of controlling the boat propulsion unit according to a preferred embodiment. As shown in the drawing, the engine 16 starts (a step S11) and initiates driving. Then, the crankshaft 66, the intake camshaft 63, and the exhaust camshaft 64 are driven. Following this, the magnetic sensor 83 senses passage of the protruding portions $\mathbf{81}_1$, $\mathbf{81}_2$, . . . , and $\mathbf{81}_{34}$, while the magnetic sensor 93 senses passage of the protruding portions $\mathbf{91}_1$, $\mathbf{91}_2$, . . . , and $\mathbf{91}_6$. Corresponding to passage of the protruding portions $\mathbf{81}_1$, $\mathbf{81}_2$, . . . , and $\mathbf{81}_{34}$ and the protruding portions $\mathbf{91}_1$, $\mathbf{91}_2$, . . . , and $\mathbf{91}_6$, the magnetic sensors 83 and 93 generate sensing signals and transmit the sensing signals to the CPU 42 of the engine side ECU 41.

Figure 9A:
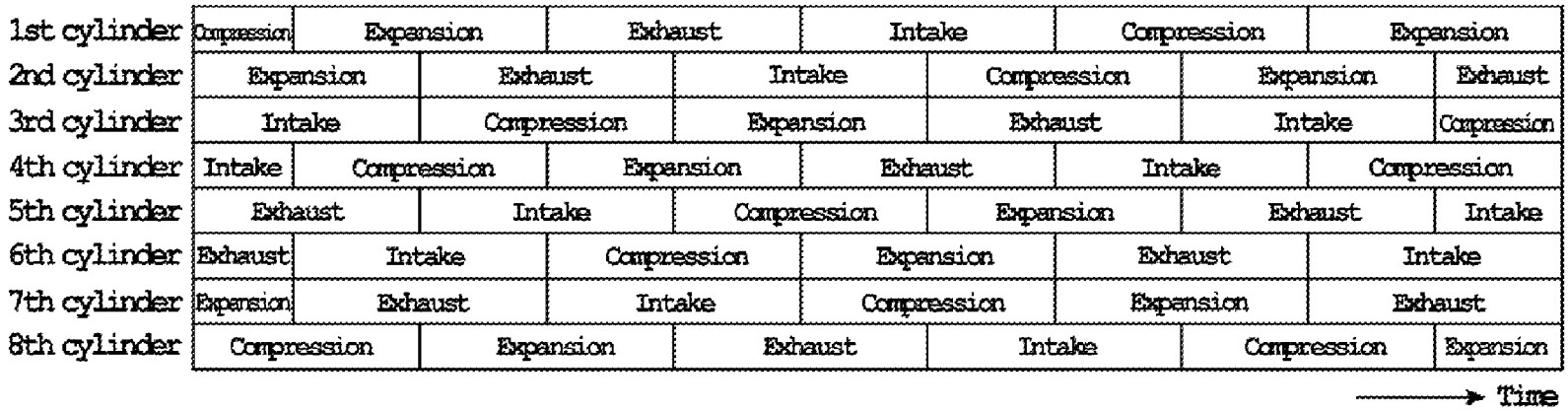
FIG. 9A is a time chart illustrating combustion cycles of cylinders and FIG. 9B is a time chart illustrating a schematic view of signals sensed by magnetic sensors according to a preferred embodiment of the present invention.
Figure 9B:
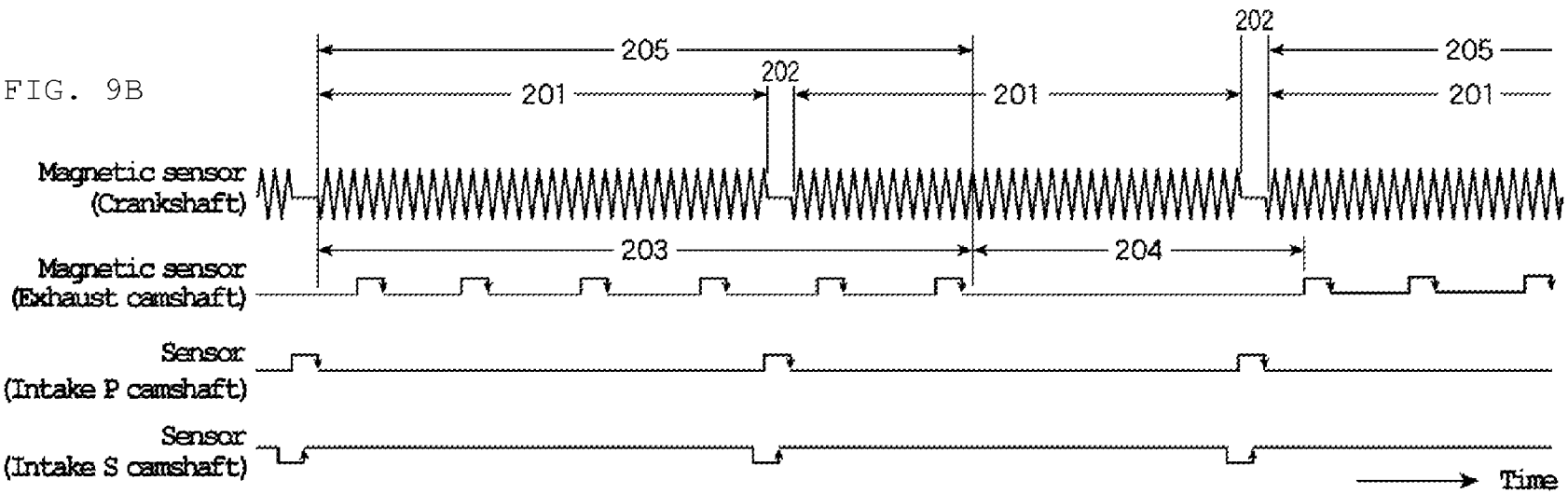

The sensing signals generated by one magnetic sensor 83 and one magnetic sensor 93 are as illustrated in a time chart in FIG. 9B. As shown in the drawing, when the protruding portions $\mathbf{81}_1$, $\mathbf{81}_2$, . . . , and $\mathbf{81}_{34}$ and the protruding portions $\mathbf{91}_1$, $\mathbf{91}_2$, . . . , and $\mathbf{91}_6$ pass the positions of the magnetic sensors 83 and 93, strong magnetic fields are generated. Accordingly, periodic high and low points are provided in the signals. On the other hand, when the omitted portions 82 and 92 pass the positions of the magnetic sensors 83 and 93, any high or low points are not provided in the signals, but the same signal intensity is continuously provided.

Accordingly, as the crankshaft 66 keeps rotating, a first block 201 in which periodic high and low points are provided as a result of passage of the protruding portions $\mathbf{81}_1$, $\mathbf{81}_2$, . . . , and $\mathbf{81}_{34}$ and a second block 202 in which a flat signal is continuously provided as a result of passage of the omitted portion 82 are alternatingly provided in the signal resulting from detection by the magnetic sensor 83. Thus, it is possible to detect the rotational speed and the rotation angle of the crankshaft 66. On the other hand, when the exhaust camshaft 64 keeps rotating, a third block 203 in which periodic high and low points are provided as a result of passage of the protruding portions $\mathbf{91}_1$, $\mathbf{91}_2$, . . . , and $\mathbf{91}_6$ and a fourth block 204 in which a flat signal is continuously provided as a result of passage of the omitted portion 82 are alternatingly provided in the signal resulting from detection by the magnetic sensor 93. Thus, it is possible to detect the rotational speed and the rotation angle of the exhaust camshaft 64.

The crankshaft 66 and the exhaust camshaft 64 are linked to rotate synchronously. When the crankshaft 66 and the exhaust camshaft 64 rotate normally (in other words, when they rotate in the normal directions), one to several numbers of the first block 201 and one to several numbers of the third block 203 are interlocked and appear at a same timing. For example, according to the time chart in FIG. 9B, six high points of signals resulting from the third block 203 appear at a timing in which a signal resulting from a specific rotation angle range 205 of the crankshaft 66 defined by two of the first blocks 201 appear. If the crankshaft 66 rotates normally, the high points of the signals resulting from the third block 203 constantly appear at a timing in which the signal resulting from the specific rotation angle range 205 appears after this example.

On the other hand, if the crankshaft 66 rotates in reverse (in other words, when the crankshaft 66 rotates in a direction opposite to the normal direction), the high points of signals resulting from the third block 203 appear at a timing different from that of the normal rotation. Therefore, the signals resulting from the third block 203 do not correctly appear at a timing in which the signal resulting from the specific rotation angle range 205 of the crankshaft 66 appear.

In the present preferred embodiment, this characteristic is used for determining whether or not the crankshaft 66 rotates in reverse.

Further, it is possible to detect the rotational speed of the engine 16 by observing intervals at which the second block 202 and the fourth block 204 appear. The rotational speed of the engine 16 is also detected by the detection method described above in the reverse rotation determination section 421.

Specifically, detection of the rotational speed of the engine 16 is performed in the reverse rotation determination section 421. When the rotational speed of the engine 16 is equal to or less than a prescribed speed, which is 2,000 rpm in this example ("Yes" in a step S12), determination of whether or not the crankshaft 66 makes a reverse rotation is performed for each cylinder of the engine 16.

When starting the determination of whether or not the crankshaft 66 of a certain cylinder (hereinafter referred to as a "first cylinder") of the engine 16 makes a reverse rotation, the reverse rotation determination section 421 acquires signals output from the magnetic sensors 83 and 93 making reverse rotations respectively and compares both signals, thereby observing whether or not the highpoints of signals resulting from the third block 203 input from the magnetic sensor 93 is seen at a timing at which the signal resulting from the specific rotation angle range 205 input from the magnetic sensor 83 appears. If the high points of signals resulting from the third block 203 are not observed at a timing at which the signal resulting from the specific rotation angle range 205 appears ("No" in a step S13$_1$), the reverse rotation determination section 421 counts a reverse rotation determination (step S14$_1$). On the other hand, if the high points of signals resulting from the third block 203 input from the magnetic sensor 93 is observed at a timing at which the signal resulting from the specific rotation angle range 205 input from the magnetic sensor 83 is seen ("Yes" in the step S13$_1$), the reverse rotation determination is not counted.

The engine 16 has a plurality of cylinders. As shown in the time chart in FIG. 9A, combustion cycles of the cylinders are different. Therefore, when each cylinder has the same construction, the observation timing is different from cylinder to cylinder. As a result, after the determination concerning the first cylinder is completed, the reverse rotation determination section 421 observes whether or not the high points of signals resulting from the third block 203 input from the magnetic sensor 93 appear at a timing at which the signal resulting from the specific rotation angle range 205 input from the magnetic sensor 83 appears concerning a second cylinder, a third cylinder, and so forth, performing such observation N times which is the number of cylinders (N>1, N=8 if the engine 16 is an eight-cylinder engine). If the high points of signals resulting from the third block 203 is not observed at a timing at which the signal resulting from the specific rotation angle range 205 appears ("No" in steps S13$_2$, S13$_3$, . . . , S13$_n$), the reverse rotation determination section 421 counts the reverse rotation determination as described above (steps S14$_2$, S14$_3$, . . . , and S14$_n$). When the observation described above is performed for all the cylinders, one time for each, if the count of the reverse rotation determination reaches N, which is the number of the cylinders ("Yes" in step S15), the reverse rotation determination section 421 determines that the crankshaft 66 has made a reverse rotation (step S16).

Figure 8:
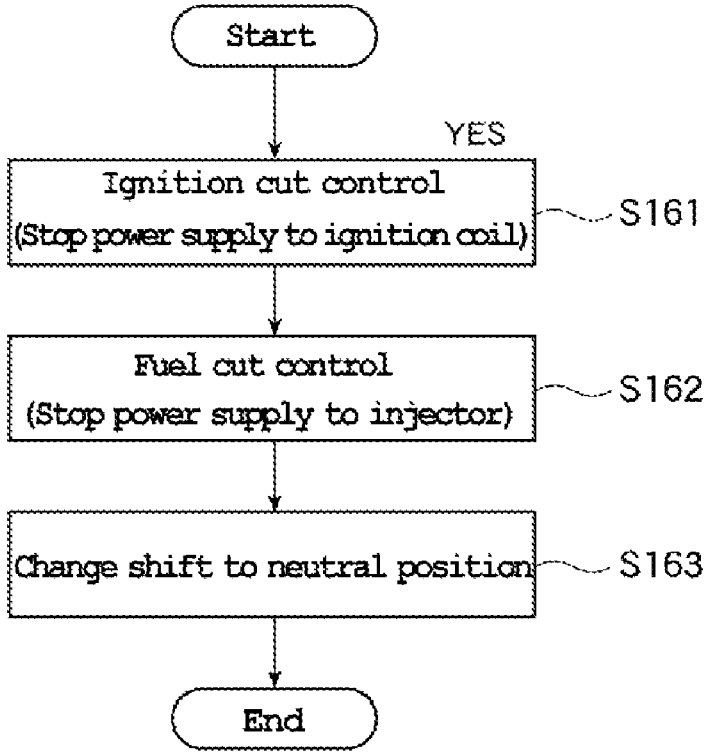
FIG. 8 is a flowchart illustrating a specific procedure in a case in which a reverse rotation determination section of the boat propulsion system according to a preferred embodiment of the present invention determines that a crankshaft makes a reverse rotation.

FIG. 8 is a flowchart illustrating a specific procedure in a case in which the reverse rotation determination section 421 determines that the crankshaft 66 makes a reverse rotation. As shown in the drawing, in this case, the drive stop section 423 stops power supply to the ignition coil 65 in order to stop the ignition of fuel (step S161) and, in addition, stops power supply to the injector 61 in order to stop the injection of fuel (a step S162). Further, the gear mechanism operation section 422 forcibly shifts the shift gear mechanism 24 to the neutral state (step S163). Specifically, the gear mechanism operation section 422 operates the shift actuator 22, slides the slider 39, slides the dog clutch 28, and shifts the shift gear mechanism 24 to the neutral state forcibly.

On the other hand, when the observation described above is performed for all the cylinders, one time for each, if the count of the reverse rotation determination does not reach N, which is the prescribed number ("No" in the step S15), the reverse rotation determination section 421 increases the count of the reverse rotation determination by one (a step S17) and resumes processing from the step S12.

When processing from the steps S161 to S163 are all completed (the step S16), or when the rotational speed of the engine 16 is not equal to or less than the prescribed speed (2,000 rpm) ("No" in the step S12), the reverse rotation determination section 421 ends processing. At this time, the processing avoidance section 424 avoids processing in the gear mechanism operation section 422 and prevents an occurrence of a state in which the shift gear mechanism 24 is shifted to the neutral position (step S18).

In the procedure described above, the step for determining the rotational speed of the engine 16 (step S12) is performed before the steps for observing the high points of signals resulting from the third block 203 (steps S13$_1$, S13$_2$, . . . , S13$_n$) when the signal resulting from the specific rotation angle range 205 appears. However, it is possible to perform the step for determining the rotational speed of the engine 16 after the case in which the count of the reverse rotation determination reaches N, the number of the cylinders ("Yes" in the step S15).

As described above, the present preferred embodiment includes the reverse rotation sensing device arranged to sense a reverse rotation of the crankshaft 66 at a time of driving the engine 16 and the gear mechanism operation section 422 for forcibly shifting the shift gear mechanism 24 provided in the outboard motor 11 into the neutral state when a reverse rotation of the crankshaft 66 is sensed by the reverse rotation sensing device. As a result, when a reverse rotation of the crankshaft 66 occurs at a time of driving the engine 16, the reverse rotation is sensed, and the shift gear mechanism 24 can be shifted in the neutral state in which the reverse rotation of the crankshaft 66 does not occur. Further, since the gear mechanism operation section 422 shifts the shift gear mechanism 24 to the neutral state which is one of the states provided by the gear mechanism 24 during a normal operation of the engine 16, it is not necessary to make the shift gear mechanism 24 and the like perform a special operation. Accordingly, any special complex construction is not necessary. As a result, it is possible to surely prevent water from entering the engine 16 from the exhaust port 20*d* regardless of a state of the gear, and it is possible to minimize an increase in the manufacturing cost and simplify the maintenance work of the engine 16.

In the present preferred embodiment, the first rotation angle sensing device 80 arranged to sense a rotation angle of the crankshaft 66 and the second rotation angle sensing device 90 provided in the engine 16 for sensing a rotational angle of the exhaust camshaft 64 engaged and driven with the crankshaft 66 are included in the sensing device of the reverse rotation sensing device. As a result, the arrangement can be made by a small number of sensing devices. Further, the reverse rotation determination section 421 determines an occurrence of a reverse rotation of the crankshaft 66 on the basis of a rotation angle sensed by the first rotation angle sensing device 80 and a rotation angle sensed by the second rotation angle sensing device 90. Consequently, a reverse rotation of the crankshaft 66 can be surely sensed based on a relative relationship between a rotation angle of the crankshaft 66 and a rotation angle of the exhaust camshaft 64.

In the present preferred embodiment, the first rotation angle sensing device 80 is provided with the protruding portions 81$_1$, 81$_2$, . . . , and 81$_{34}$ as a first mark section provided at specific positions on the crankshaft 66 and the magnetic sensor 83 as a first passage sensing device provided in a specific position on the crankshaft 66 for sensing whether or not the protruding portions 81$_1$, 81$_2$, . . . , and 81$_{34}$ pass the specific position. In addition, the second rotation angle sensing device 90 is provided with the protruding portions 91$_1$, 91$_2$, . . . , and 91$_6$ as a second mark section provided at specific rotation angle positions of the exhaust camshaft 64 and the magnetic sensor 93 as a second passage sensing device provided at a specific position on the exhaust camshaft 64 for sensing whether or not the mark section passes the specific position. Further, when the protruding portions $\mathbf{81}_1$, $\mathbf{81}_2$, . . . , $\mathbf{81}_{34}$ as the first mark section and the protruding portions $\mathbf{91}_1$, $\mathbf{91}_2$, . . . , and $\mathbf{91}_6$ as the second mark section are sensed at a timing different from that of a time when the exhaust camshaft 64 performs a normal rotation, since the reverse rotation determination section 421 determines that the crankshaft 66 has made a reverse rotation, an occurrence of a reverse rotation of the crankshaft 66 can be sensed based on a positional relationship of the specific rotation angle positions provided on the crankshaft 66 and the exhaust camshaft 64 and a passing state of the specific rotation angle positions. Still further, the specific rotation angle positions of the crankshaft 66 and the exhaust camshaft 64 can be sensed with the protruding portions $\mathbf{81}_1$, $\mathbf{81}_2$, . . . , and $\mathbf{81}_{34}$ of the crankshaft 66 and the protruding portions $\mathbf{91}_1$, $\mathbf{91}_2$, . . . , and $\mathbf{91}_6$ of the exhaust camshaft 64 provided in the specific rotation angle positions. Therefore, a construction for sensing the specific rotation angle positions can be formed in a simple arrangement.

In the present preferred embodiment, the first mark section is a plurality of the protruding portions $\mathbf{81}_1$, $\mathbf{81}_2$, . . . , and $\mathbf{81}_{34}$ provided at specific rotation angle positions around the crankshaft 66, and the second mark section is the protruding portions $\mathbf{91}_1$, $\mathbf{91}_2$, . . . , and $\mathbf{91}_6$ provided at specific rotation angle positions around the exhaust camshaft 64. Therefore, the mark sections for indicating specific rotation angle positions can be formed in a simple construction. In addition, the first passage sensing device and the second passage sensing device are preferably the magnetic sensors 83 and 93 provided in the vicinity of the protruding portions $\mathbf{81}_1$, $\mathbf{81}_2$, . . . , and $\mathbf{81}_{34}$ and the protruding portions $\mathbf{91}_1$, $\mathbf{91}_2$, . . . , and $\mathbf{91}_6$. Therefore, the passage sensing device can be formed in a simple construction.

In the present preferred embodiment, the drive stop section 423 is provided for stopping an operation of the injector 61 and an operation of the ignition coil 65 at a time when a reverse rotation of the crankshaft 66 is detected. Therefore, a factor for generating combustion in the combustion chamber 58 at a time of a reverse rotation of the crankshaft 66, which is a factor for intensifying the reverse rotation of the crankshaft 66, can be blocked.

In the present preferred embodiment, the processing avoidance section 424 for avoiding processing in the gear mechanism operation section 422 at a time when the rotational speed of the engine 16 is equal to or more than the prescribed speed is provided. Therefore, it is prevented that running trouble occurs when the shift gear mechanism 24 is shifted in the neutral position despite the fact that a reverse rotation of the crankshaft 66 does not occur because the shift gear mechanism 24 is forcibly shifted in the neutral state due to an incorrect detection in a case other than a low rotational speed of the engine 16 such as during usual running.

In the present preferred embodiment, the first mark section is defined as a plurality of the protruding portions $\mathbf{81}_1$, $\mathbf{81}_2$, . . . , and $\mathbf{81}_{34}$ provided at specific rotation angle positions around the crankshaft 66, and the second mark section is defined as the protruding portions $\mathbf{91}_1$, $\mathbf{91}_2$, . . . , and $\mathbf{91}_6$ provided at specific rotation angle positions around the exhaust camshaft 64. However, the first mark section may be defined by the omitted portion 82 of the crankshaft 66, and the second mark section may be defined by the omitted portion 92 of the exhaust camshaft 64.

In the present preferred embodiment, when the rotational speed of the engine 16 is equal to or more than the prescribed, the processing avoidance section 424 avoids processing in the gear mechanism operation section 422 for forcibly shifting the shift gear mechanism 24 in the neutral state. In place of this, the processing avoidance section 424 may perform processing for discontinuing sensing processing by the magnetic sensors 83 and 93 or may perform processing for discontinuing processing in the step $\mathbf{S13}_1$ to the step S16 based on a result of processing by the magnetic sensors 83 and 93.

In the present preferred embodiment, the outboard motor 11 is preferably used as the boat propulsion system. However, it is understood that an inboard-outboard engine may be used. Further, the preferred embodiment above illustrates an example, but it is understood that the preferred embodiments do not limit the present invention to the preferred embodiments above.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A control device for a boat propulsion system including an internal combustion engine provided with a crankshaft, the control device comprising:

a reverse rotation sensing device arranged to sense a reverse rotation of the crankshaft during driving of the internal combustion engine; and a gear mechanism operation device arranged to immediately start a process of forcibly shifting a gear mechanism provided in the boat propulsion system into a neutral state when a reverse rotation of the crankshaft is sensed by the reverse rotation sensing device.

2. The control device for a boat propulsion system according to claim 1, wherein the reverse rotation sensing device further includes:

a first rotation angle sensing device arranged to sense a rotation angle of the crankshaft;

a second rotation angle sensing device provided in the internal combustion engine and arranged to sense a rotation angle of a camshaft engaged and driven with the crankshaft; and a reverse rotation determination device arranged to determine an occurrence of a reverse rotation of the crankshaft based on a rotation angle sensed by the first rotation sensing device and a rotation angle sensed by the second rotation sensing device.

3. The control device for a boat propulsion system according to claim 2, wherein the first rotation angle sensing device includes a first mark section provided at a specific rotation angle position of the crankshaft and a first passage sensing device provided at a specific position around the crankshaft and arranged to sense whether or not the first mark section passes the specific position;

the second rotation angle sensing device includes a second mark section provided at a specific rotation angle position of the camshaft and a second passage sensing device provided at a specific position around the camshaft and arranged to sense whether or not the mark section passes the specific position; and the reverse rotation determination device determines that the crankshaft reversely rotates if the first mark section and the second mark section are sensed at a timing different from that of a time when the camshaft normally rotates.

4. The control device for a boat propulsion system according to claim 3, wherein at least one of the first mark section and the second mark section is a protruding portion provided at a specific rotation angle position on the crankshaft or the camshaft, or an omitted portion resulting from omitting a portion at a specific rotation angle position of a plurality of the protruding portions provided at regular intervals, and at least one of the first passage sensing device and the second passage sensing device is a magnetic sensor provided in a vicinity of a projected position of the protruding portion.

5. The control device for a boat propulsion system according to claim 1, further comprising a drive stop device arranged to stop an operation of an injector for providing fuel to a combustion chamber of the internal combustion engine and an operation of an ignition coil for igniting fuel in the combustion chamber when a reverse rotation of the crankshaft is sensed by the reverse rotation sensing device.

6. The control device for a boat propulsion system according to claim 1, further comprising:

a processing avoidance device arranged to avoid operation by the gear mechanism operation device when a rotational speed of the internal combustion engine is equal to or more than a prescribed speed.

7. A boat comprising the control device for a boat propulsion system according to claim 1.

8. A control device for a boat propulsion system including an internal combustion engine provided with a crankshaft, the control device comprising:

a reverse rotation sensing device arranged to sense a reverse rotation of the crankshaft during driving of the internal combustion engine; and a gear mechanism operation device arranged to forcibly shift a gear mechanism provided in the boat propulsion system into a neutral state when a reverse rotation of the crankshaft is sensed by the reverse rotation sensing device and without having to first satisfy a precondition for shifting the gear mechanism into the neutral state.

* * * * *